US005980242A

United States Patent [19]

Man

[11] Patent Number: 5,980,242

[45] Date of Patent: Nov. 9, 1999

[54] CHILD RESISTANT BARBECUE AND FIREPLACE LIGHTER

[76] Inventor: Aman Chung Kai Man, Unit 1, 11/F, Wah Lai Ind. Centre, 10-14 Kwei Tei Street, Fo Tan Shatin, N.T., The Hong Kong Special Administrative Region of the People's Republic of China

[21] Appl. No.: 08/935,078

[22] Filed: Sep. 25, 1997

[51] Int. Cl.[6] ..... F23D 14/28

[52] U.S. Cl. ..... 431/344; 431/153; 431/255; 431/345; 126/258

[58] Field of Search ..... 431/344, 345, 431/255, 266; 126/25 B, 404, 407, 414; 42/70.07, 70.06

[56] References Cited

U.S. PATENT DOCUMENTS

| | | | |
|---|---|---|---|
| 2,525,886 | 10/1950 | Fraser | 42/70.07 |
| 5,024,017 | 6/1991 | Nishioka | 42/70.07 |
| 5,322,433 | 6/1994 | Shike et al. | 431/344 |
| 5,697,775 | 12/1997 | Saito et al. | 431/153 |
| 5,738,507 | 4/1998 | Mifune et al. | 431/344 |

*Primary Examiner*—James C. Yeung
*Attorney, Agent, or Firm*—David O'Reilly

[57] ABSTRACT

A BBQ or fireplace lighter, including a child resistant device to prevent operation by children, and in particular, small children. In one embodiment, the device is in the form of a pivotally mounted lever having a notch engaging a plate in the trigger, locking the trigger from operation. The trigger release mechanism includes a button extending out of the lighter housing immediately behind the trigger guard for operation by a finger while the trigger is operated by the index or another finger. A second embodiment is comprised of a trigger guard plate having a thumb tab extending out of the top of the housing mounted on a rotatable hub. The guard plate engages and obstructs operation of the trigger. A spring biases the guard plate against the trigger to prevent operation, but can be rotated out of the way by rotating the thumb tab to a stop position moving trigger guard plate out of engagement of the trigger, allowing operation of the BBQ or fireplace lighter. A third embodiment has a button extending out the top of the housing with a stop disk engaging a keyhole slot in the trigger preventing operation until the button is pushed down.

6 Claims, 6 Drawing Sheets

CHILD RESISTANT BARBECUE AND FIREPLACE LIGHTER

BACKGROUND OF THE INVENTION

1. Field of the Invention

This invention relates to disposable barbecue (BBQ) and fireplace lighters and more particularly, relates to child resistant safety devices for such lighters.

2. Background Information

There are a variety of disposable BBQ and fireplace lighters presently available on the market. These devices generally have a reservoir containing an ignition fluid in the handle, and generate electric spark to ignite the fluid which turns into a gas at a nozzle tip into a flame when a trigger is operated. An electrical spark is usually created by a piezoelectric cartridge, or similar device in the handle of the lighter.

These lighters have an elongate handle and nozzle to keep the flame well away from the user. The elongate construction allows the user to safely use the flame to ignite BBQs, fireplaces, etc. without getting near the flame. Unfortunately, these devices have the appearance of a toy to children who could accidentally start a fire, or injure themselves by improper use.

To ignite the flame, the trigger is operated, allowing ignition fluid such as propane to flow to the nozzle tip. Almost simultaneously, as the trigger reaches the end of its travel, a spark is generated by a piezoelectric cartridge and the ignition fluid erupts into a flame at the tip of the nozzle. A regulator is usually provided to regulate the size of the flame by regulating the flow of ignition fluid. The flame is then conveniently used to ignite a BBQ, fireplace, candles, etc., or any other place where a match would be used.

Various attempts have been made to incorporate child resistance into BBQ lighters and similar devices, such as cigarette lighters and the like. They are usually in the form of devices which prevent the flow of ignition fluid, or lock the trigger. The purpose of these devices is making them convenient to use, while at the same time, providing sufficient resistance to prevent or to deter use by children. Locking the trigger is somewhat effective, but children can often "solve the riddle", and easily unlock the trigger. Also, a user must remember to relock the trigger after use, which is another inconvenience.

Therefore, it is one object of the present invention to provide a BBQ and fireplace lighter with improved child resistance safety device.

Yet another object of the present invention is to provide a BBQ and fireplace lighter with a trigger release button that automatically relocks the trigger when released.

Another object of the present invention is to provide a trigger release button behind the trigger, for easy operation with one hand.

Yet another object of the present invention is to provide a trigger release button that is pushed up with the middle finger to release the trigger, allowing operation by an index finger.

Still another object of the present invention is to provide a BBQ or fireplace lighter having a trigger release button that is simple and easy for adults to operate, but difficult for manipulation by children.

Yet another object of the present invention is to provide a BBQ or fireplace lighter having a trigger release button with a trigger engaging abutment and an integrally formed leaf spring holding a abutment in engagement with the trigger.

Still another object of the present invention is to provide BBQ or fireplace lighter having a trigger release lever that includes a guard plate, blocking operation of the trigger.

Yet another object of the present invention is to provide a BBQ or fireplace lighter having a trigger release lever with a thumb tab to swivel a blocking trigger guard plate away from the trigger, allowing operation of the lighter.

BRIEF DESCRIPTION OF THE INVENTION

The purpose of the present invention is to provide a BBQ or fireplace lighter with a child resistant safety device which is simple in construction, but effective in use. The BBQ lighter has a handle that serves as a housing for ignition fluid reservoir and an electric spark generator. An elongate nozzle extends outward from the handle to a lighter nozzle tip. Ignition fluid is delivered by a tube connected to the ignition fluid reservoir and nozzle tip. Each operation of the trigger releases fluid to the tip, which expands into a gas for ignition.

An electric spark is generated at nozzle tip by a spark generator in the handle, connected to a spark gap usually a piezoelectric cartridge to ignite the fluid exiting the nozzle tip. The size of the flame is adjusted by adjusting the flow of ignition fluid by rotation of a regulator or control that open and closes a valve on an exit port of the ignition fluid reservoir. The flame can be adjusted after it is lit, or if the user is having difficulty igniting the flame, the flow can be adjusted for optimum ignition before pulling the trigger.

In one embodiment, the trigger is locked by a pivotable mounted lever, having an abutment or notch engaging the trigger, preventing it's operation. An integrally formed, resilient leaf spring on the lever engages the housing and keeps the abutment in contact with the trigger. The trigger is released by a button attached to the pivotally mounted lever that is positioned outside the housing, just behind the trigger. Preferably, the trigger release button is positioned in the housing just behind the trigger guard. This allows simple operation by an adult, but requires substantial dexterity that makes operation by the small hands of a child difficult, if not all but impossible.

The trigger may be operated by an index finger, while the middle finger is pulled up on the release button, displacing the locking abutment to release the trigger. After the fluid exiting the tip is lit, creating the flame, the trigger is released shutting down the flame and the integrally formed leaf spring re-engages the locking abutment against the trigger.

A unique advantage of the BBQ lighter is a trigger release mechanism that is very simple in construction and easy to use, but very effective as a child resistant device. The trigger release mechanism is a one homogeneous piece, comprised of the pivotally mounted lever, having an abutment or notch, engaging the trigger, a resilient integrally formed leaf spring, and a release button. This construction is such that the trigger is securely locked automatically, yet it only takes a small movement to release the trigger. Yet it is an effective deterrent to use by children because it requires considerable dexterity to operate. Simultaneous index finger and middle finger movement and coordination is generally beyond the capability of most children, and particularly small children because of their small hands. They are most vulnerable to the beguiling appearance of the BBQ lighter as a toy and least likely to appreciate the danger from the flame. This device is a very effective and elegant solution to the problem of use by children, by providing a child resistant device that is very uncomplicated in construction.

A second embodiment is disclosed that employs a rotatably mounted lever having a trigger guard plate that blocks movement of the trigger until it is rotated up and away from the trigger. This device has a blocking trigger guard plate instead of the end abutting the trigger mounted on a rotatable thumb tab. The rotable thumb tab extends out of the top of the housing through an opening for operation by the thumb. A coil spring holds the locking guard plate in abutment with the trigger, preventing its operation.

To operate the trigger, the guard plate must be displaced away from the trigger by operating the rotatable thumb tab with the thumb. Further, the rotatable thumb tab must be held in that position to keep the rotator plate away from the trigger. Also, since the trigger must be held in an on position to keep lighter fluid flowing to the tip this makes it even more difficult for children to use. The trigger is now free for operation by an index or middle finger. A unique feature is that the rotatable lever and hence, the locking plate, must be held in position out of the way, while the trigger is operated.

It should be remembered that operation of a BBQ lighter trigger requires some considerable force and rapid movement to deliver lighter fluid from the ignition fluid reservoir to the nozzle tip, and generate an electrical spike that produces a spark to ignite the fluid to start the flame. This means substantial dexterity is required to hold the rotatable lever and locking plate out of the way, while simultaneously operating and holding the lighter trigger to ignite the fluid delivered pump to the nozzle tip.

The locking plate and rotatable lever are preferably formed as an integral part rotatably mounted on a pivot pin in the housing. A coil spring, on the pivot pin, holds the locking plate and engagement with the trigger. Thus, the rotatable lever must be pulled back and held in a withdrawn position to allow access to the trigger. Release of the rotatable lever allows the locking plate to return to trigger blocking lock position automatically.

The above and other novel features of the invention will be more fully understood from the following detailed description and the accompanying drawings, in which:

DETAILED DESCRIPTION OF THE INVENTION

Figure 1:
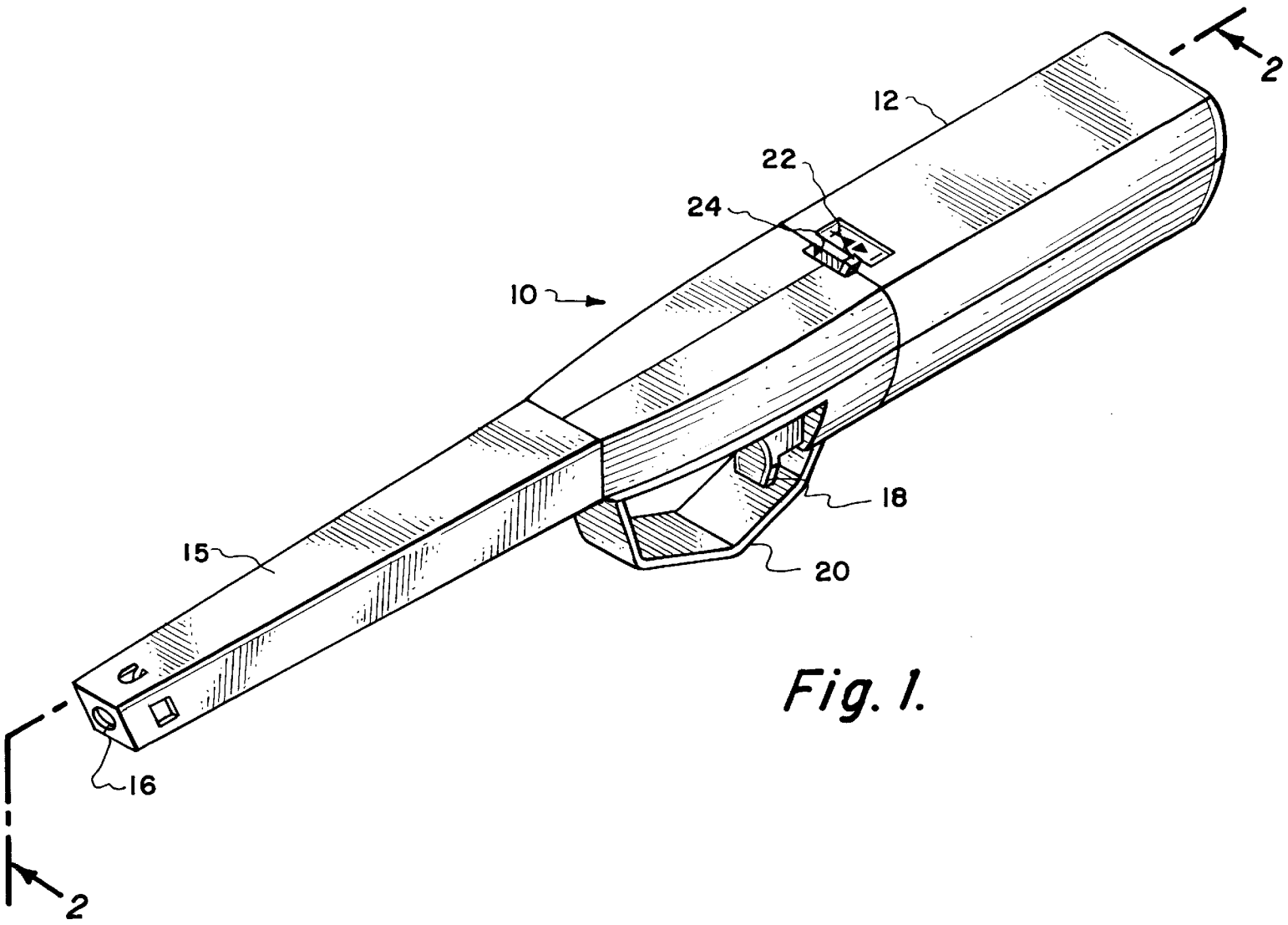
FIG. 1 is an isometric view of a BBQ or fireplace lighter according to the invention.

A BBQ or fireplace lighter 10 is illustrated generally in FIG. 1, and is comprised of a housing 12, forming a handle and a nozzle 15, extending away from the handle, having a nozzle tip 16 for producing a flame. Lighter fluid is delivered to nozzle tip 16 by trigger 18, protected by guard 20. The flow of lighter fluid to nozzle tip 16 is controlled by stem 22 attached to a flow regulating valve as will be described in greater detail hereinafter. Movement of stem 22 in slot 24, in housing 12 increases or decreases the flow of lighter fluid to nozzle tip 16.

Figure 2:
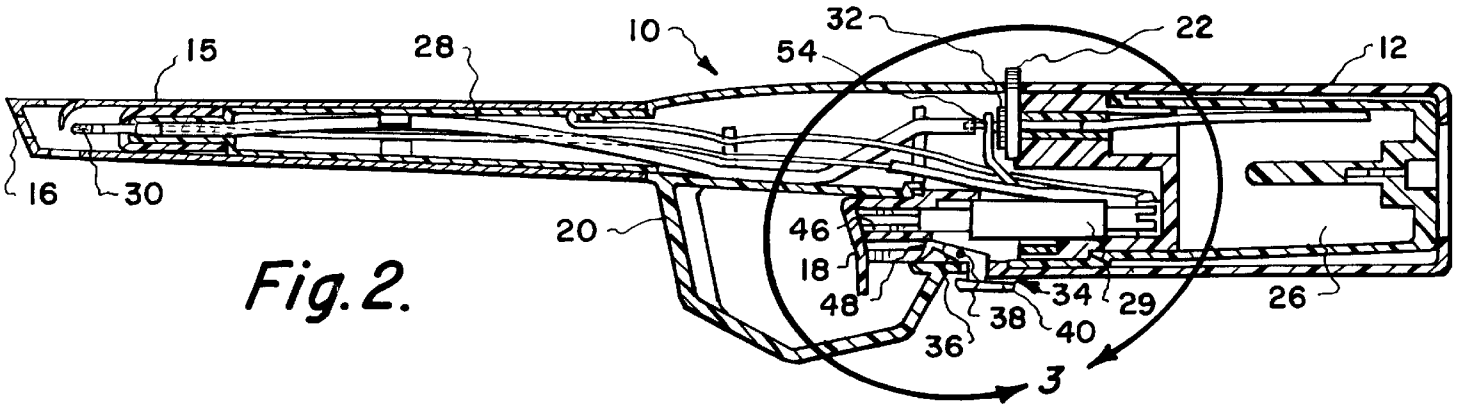
FIG. 2 is a sectional view taken at 2—2 of FIG. 1.
Figure 4:
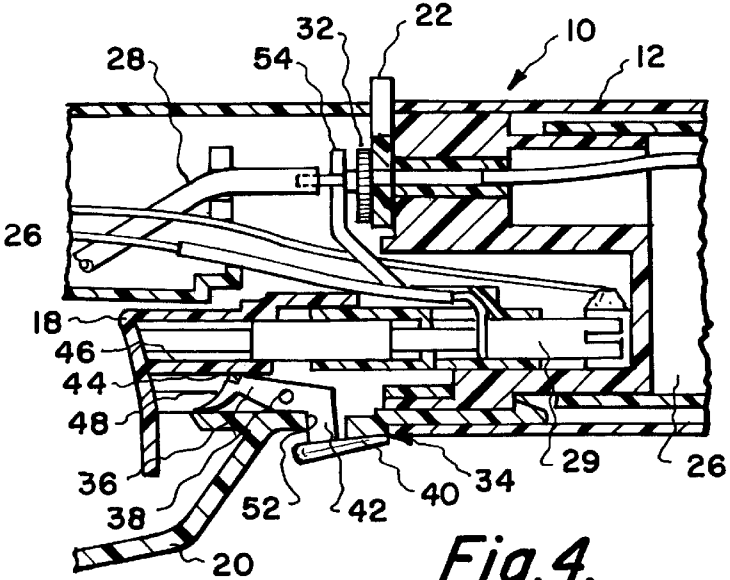
FIG. 4 is a partial sectional view similar to FIG. 3, illustrating the BBQ or fireplace lighter trigger being released.
Figure 3:
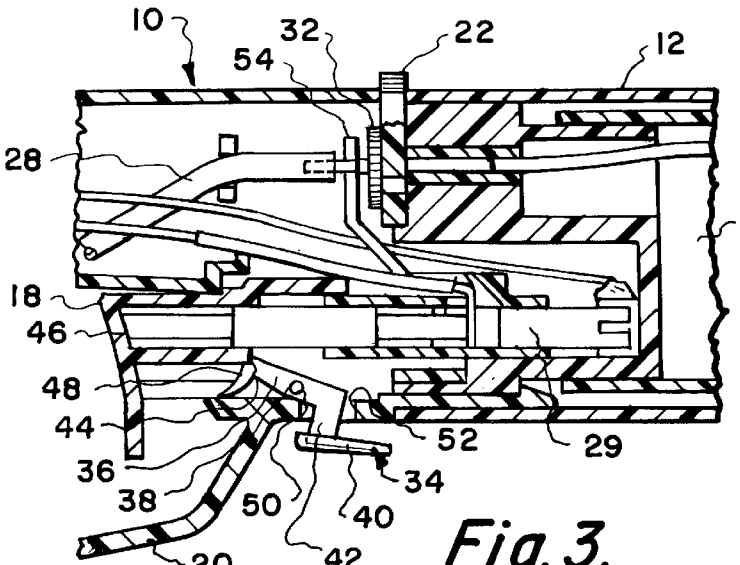
FIG. 3 is a partial sectional view illustrating operation of the child resistant locking device taken at 3 of FIG. 2.

The construction of the BBQ or fireplace lighter in FIG. 1 is shown in the sectional views of FIGS. 2 through 4. Housing 12 has an ignition fluid reservoir 26 connected to the nozzle tip 16 by tube 28. The flame is ignited by an electrical spark from spark generator 29, generating a spark at spark gap 30 igniting the flame. Stem 22 operates regulator 32, controlling the amount of lighter fluid flowing from reservoir 26 through tube 28 to nozzle tip 16.

The operation of the BBQ or gas lighter 10 is conventional and well known in the art. operation of trigger 18 releases fluid from reservoir 26 through tube 28 to nozzle tip 16. Continued travel of trigger 18 activates electrical spark generator 29, creating a spark at spark gap 30, igniting lighter fluid as it exits the tip. The flow of fluid to nozzle tip 16 is controlled by movement of stem 22 side-to-side, which operates regulating valve 32 to control the volume of lighter fluid flowing to nozzle tip 16.

A unique feature of the invention is the inclusion of a child resistant locking device 34, that prevents operation of trigger 18, unless it is released. Trigger locking and release mechanism 34 is a one piece construction, and is comprised of a lever 36, mounted on a pivot pin 38, having an operating button 40 attached by flange 42. Notch 44 is constructed to engage trigger plate 46 to prevent operation of trigger unless trigger release mechanism 34 is operated by button 40. An integrally formed leaf spring 48, abutting surface 50 of housing 12, holds notch 44 of trigger release mechanism 34 in abutment with trigger 18, preventing its operation.

Notch 44 securely locks trigger 18, but is small enough that it can be easily released by a short upward movement on button 40. Flange 42 and button 40 extend through opening 52 in housing 12, just behind trigger guard 20 so that the trigger release mechanism may be easily operated with one hand by an adult. The size and shape of lever 36, integrally formed leaf spring 48 and notch 44 are such that they securely lock trigger 18 preventing operation, but only a small amount of movement is needed to release the trigger.

The operation of the BBQ and fireplace lighter, with the trigger release mechanism 34, is illustrated in FIGS. 3 and 4. Trigger 18 is locked by engagement with notch 44, on trigger release mechanism 34, in abutment with plates 46. Notch 44 is securely held in place against trigger plate 46 by integrally formed leaf spring 48. To operate the lighter, an index finger is placed on trigger 18, and the middle finger engaging button 40 of trigger release mechanism 34. A small upward force by the middle finger bends leaf spring 48, dislodging notch 44 from plate 46 in trigger 18. This allows trigger 18 to travel backward, operating fluid release lever 54, releasing lighter fluid from fluid reservoir 26 to nozzle tip 16 at the end of lighter nozzle 15. Continued force on trigger 18 engages spark generator 29, generating a spark at spark gap 30, igniting the lighter fluid and producing a flame which is regulated by stem 22. When trigger 18 is released the flow of lighter fluid stops and the flame is extinguished. Leaf spring 48 then forces the forward end of lever 36 upward causing notch 44 to again engage trigger plate 46, locking trigger 18.

A second embodiment of the invention, in which like reference numbers indicates like parts is illustrated in FIG.

5. This device is also a BBQ or fireplace lighter having the same general construction as the fireplace lighter of FIG. 1. BBQ or fireplace 10' is comprised of a housing 12, a nozzle 15 having a nozzle tip 16 for providing a flame for lighting BBQs, fireplaces and the like. Stem 22, extending from slot 24, in housing 12, regulates the flow of lighter fluid to nozzle tip 16 as previously described. The lighter is operated by a trigger 60. BBQ or fireplace lighter 10' includes a child resistant trigger guard 62 to prevent operation of trigger 60 as will be described in greater detail hereinafter. In this BBQ or fireplace lighter, the operation, except for the child resistant device, is the same as that described with respect to the embodiment of FIGS. 1 through 4.

Figure 6:
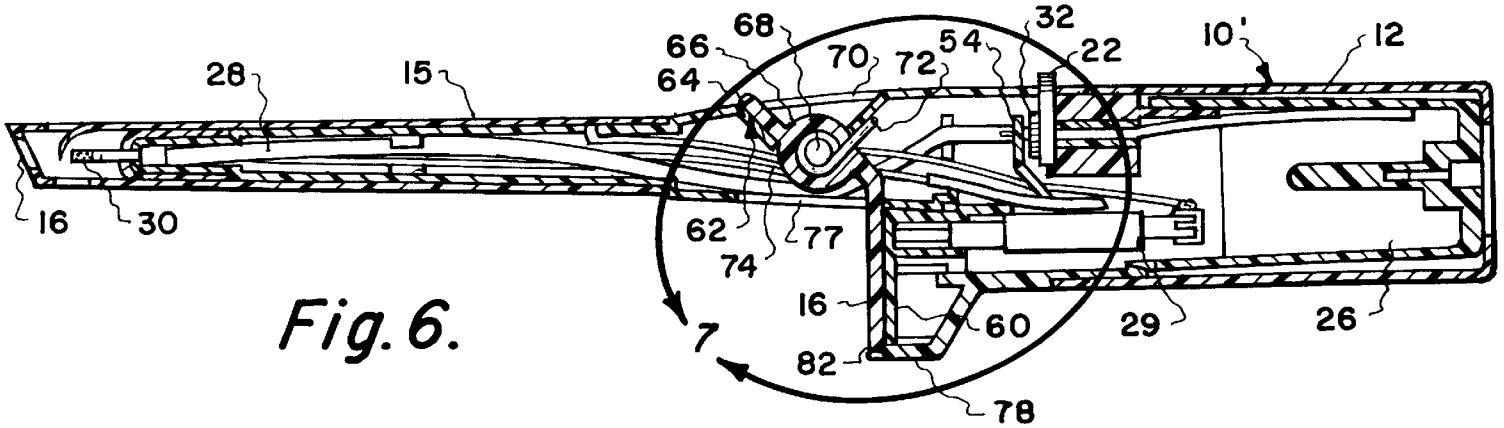
FIG. 6 is a sectional view taken at 6—6 of FIG. 5.
Figure 8:
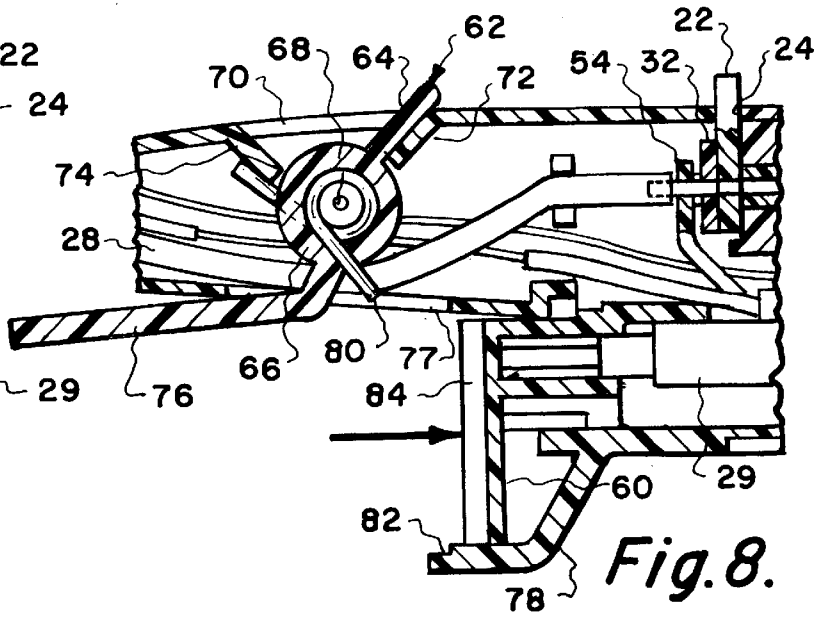
FIG. 8 is a view similar to FIG. 7 illustrating the child resistant locking device in operation.
Figure 7:
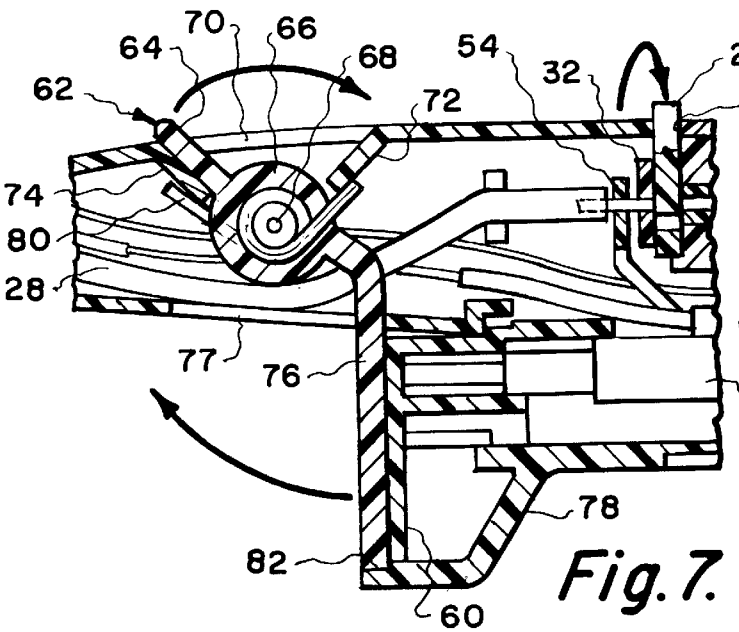
FIG. 7 is a partial sectional view illustrating operation child resistant locking device taken at 7 of FIG. 6.

A detailed view, illustrating the construction and operation of the second embodiment is shown in FIGS. 6 through 8. BBQ or fireplace lighter 10' has a lighter fluid reservoir 26 for delivering lighter fluid to nozzle tip 16 through tube 28, as before. As previously described, trigger 60 operates valve lever 54 to release fluid 26 through tube 28, to nozzle tip 16. Continued operation of trigger 60 activates spark generator 29 creating a spark at spark gap 30, igniting the fluid as it exits tube 28 and expands into a gas. Stem 22 operates valve 32 to adjust the flow of lighter fluid from reservoir 26.

This embodiment includes a unique child resistant trigger guard 62 to prevent operation of trigger 60. Child resistant trigger guard 62 is comprised of thumb tab 64, extending from cylindrical hub 66 rotatably mounted on pivot pin 68 biased by spring 80. Thumb tab 64 extends through hole 70 in the upper surface of housing 12, having stops 72 and 74. Guard plate 76 extends from hub 66 through opening 77 in housing 12 into engagement with trigger 60 and rests in notch on trigger cover 78 against recess in trigger 60. Guard plate 76 prevents operation of trigger 60 until it is displaced from its position in front of trigger 60. Spring 80 returns guard plate 76 to notch 82 in trigger cover 78 and recess 84 in trigger 60.

To operate trigger guard 62 of the second embodiment, thumb plate 64 is pulled back against stop 72, lifting guard plate 76 out of recess 84 in trigger 60, and notch 82 in trigger guard 78, allowing trigger 60 to be operated by an index finger. As shown in FIG. 8. Thumb tab 64 must be held in position against stop 72 while trigger 60 is operated, which requires considerable dexterity since trigger 60 must be moved with some force in order to release fluid and nearly simultaneously, activate spark generator 29. Also trigger 60 must be held in the "on" position or the flame will not stay lit. Once the flame is lit at nozzle tip 16, on nozzle 15, the index finger may be removed from trigger 60 and thumb tab 64 released, allowing guard plate 76 to return to its position in recess 84 and trigger 60, and notch 82 in trigger guard 78.

Trigger guard 62 effectively prevents children, and particularly small children from using BBQ or fireplace 10'. Trigger guard 62 of the present invention requires considerable dexterity to operate thumb tab 64 and hold it with trigger guard plate 76 released from trigger 60. It must be held in this position while trigger 60 is operated and held on. This is because release of thumb tab 64 automatically returns trigger guard plate 76 to its position seated in recess 84 trigger 60 because of the force of coil spring 80. Thus, after the lighter is operated, the child resistant trigger guard is automatically repositioned to prevent operation by children.

Preferably, trigger guard 62 is comprised of a single one piece homogeneous construction in which thumb tab 64 and guard plate 76 are integrally formed on hub 66. A molded construction, or some other means such as injection molding can be used to produce trigger guard 62. This construction simplifies the assembly and operation of trigger guard 62. Thus, trigger guard 62 is comprised of only two parts; integral thumb tab 64, hub 66 and guard plate 76, and spring 80.

In a second embodiment, trigger guard 62 is provided, comprised of a thumb plate attached to a rotatable hub, having a guard plate in front of the trigger. Thumb plate must be pulled backwards, up against a stop 72 to hold trigger guard plate 76, released from trigger 60 to allow operation. Trigger guard 62 must be held in this position while the trigger is operated by an index finger. This also requires considerable dexterity because the instant that the trigger guard is released it will return into position against the trigger because of the biasing spring rotating the hub extinguishing any flame. The manipulation of trigger guard 62 requires some dexterity, not only to operate, but also to hold thumb tab in position while trigger is operated and held on. Premature release could cause trigger plate to snap back against index finger and would cause some discomfort to a child's finger while still on the trigger, but not enough to cause injury. This would also discourage their attempts to use the BBQ or fireplace lighter.

Figure 5:
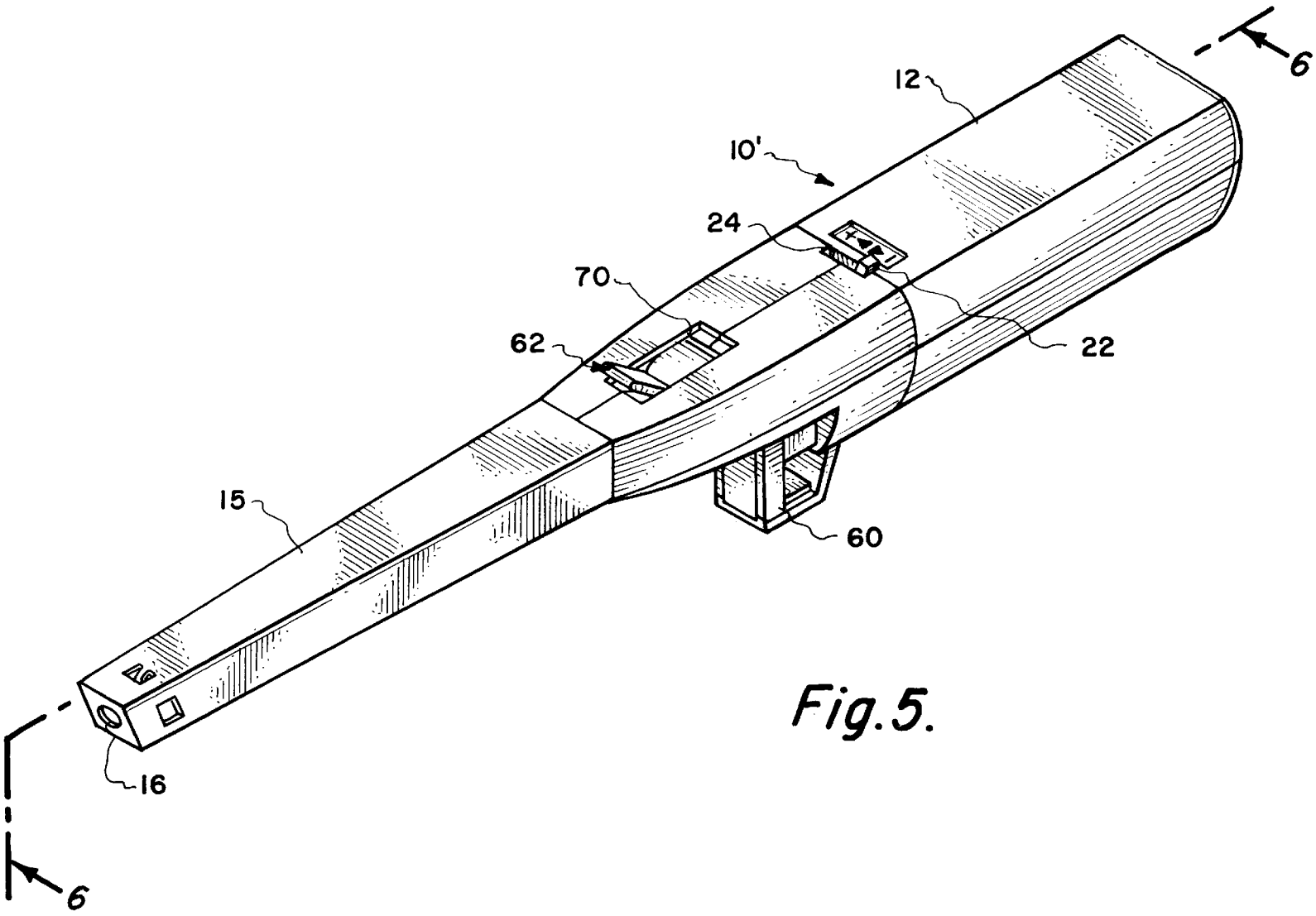
FIG. 5 is an isometric view of a second embodiment of the invention.
Figure 9:
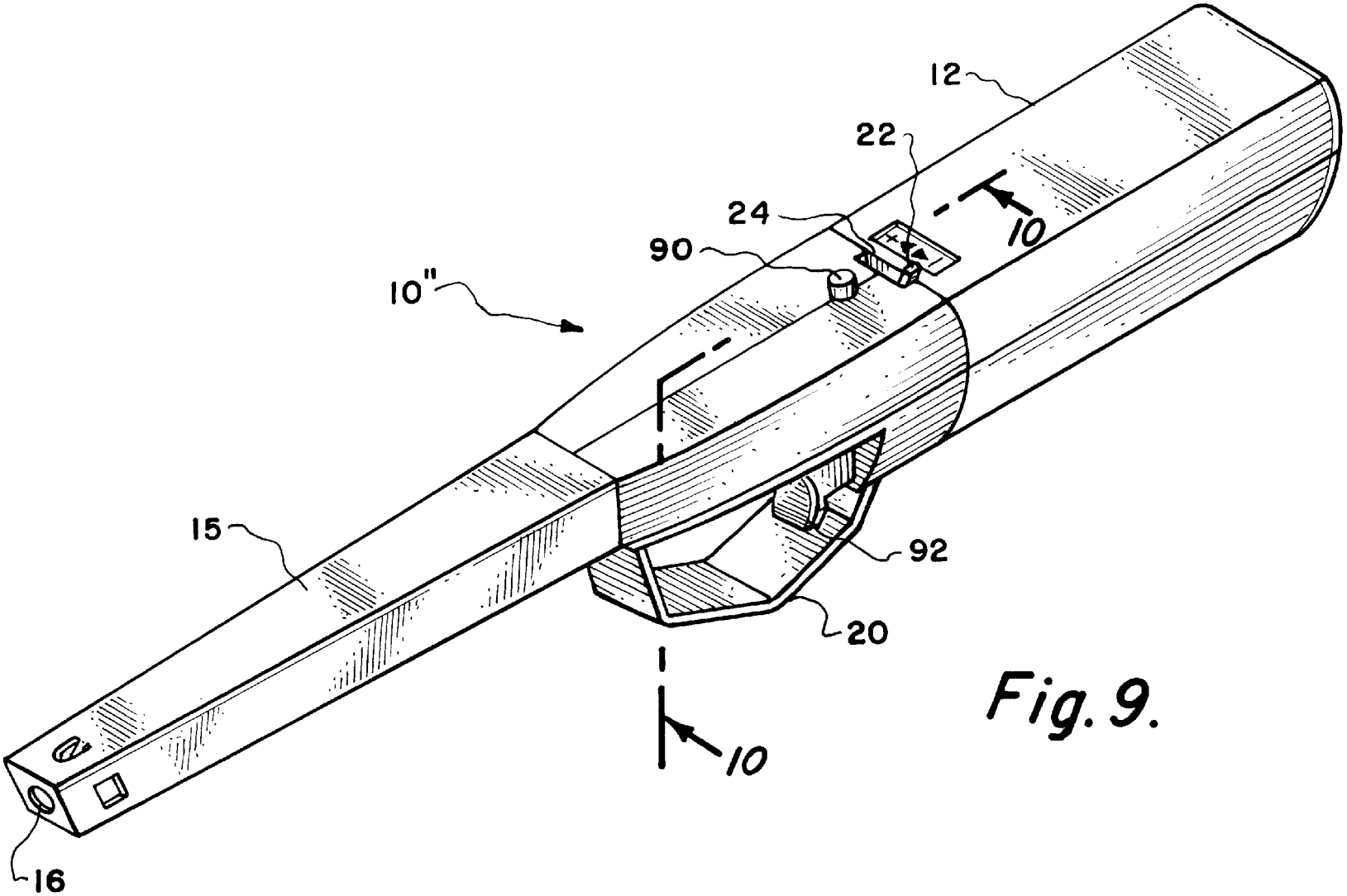
FIG. 9 is an isometric view of a third embodiment of the invention.

A third embodiment of the invention, in which like reference numbers indicates like parts is illustrated in FIG. 9. This device is also a BBQ or fireplace lighter having the same general construction as the fireplace lighter of FIG. 1. BBQ or fireplace 10" is comprised of a housing 12, a nozzle 15 having a nozzle tip 16 for providing a flame for lighting BBQs, fireplaces and the like. Stem 22, extending from slot 24, in housing 12, regulates the flow of lighter fluid to nozzle tip 16 as previously described. The lighter is operated by a trigger 92. BBQ or fireplace lighter 10" includes a child resistant operating button 96 to prevent operation of trigger 92 as will be described in greater detail hereinafter. In this BBQ or fireplace lighter, the operation, except for the child resistant device, is the same as that described with respect to the previous embodiments of FIGS. 1 and 5.

The construction and operation of the third embodiment is illustrated in FIGS. 10 through 13. This embodiment is for a BBQ or fireplace lighter that in operation, is substantially identical to the embodiments shown in FIGS. 1 and 5, except for the child resistant trigger locking device. Some details of the prior embodiments are omitted for clarity.

The BBQ or fireplace 10" has a reservoir 26, spark generator 29, housing 12 and release valve 32, as shown in the prior embodiments. The difference here is in the child resistant locking device of 90 to automatically lock trigger 92 to prevent use by a child.

Locking device 90 is comprised of a post 94, having a button 96 extending through hole 98 in housing 12. Post 94 is mounted in socket 100 in post mount turret 102. A coil spring 104, mounted between a flange 103 on post mount turret 102 and shoulder 106 on post 94, holds button 96 extended through hole 98 in housing 12. A stop disk 108, mounted on stem 110 of post 94, engages a keyhole slot 112 in trigger 92, preventing operation of the trigger. Trigger 92 may move slightly, but not enough to ignite a flame.

Figure 13:
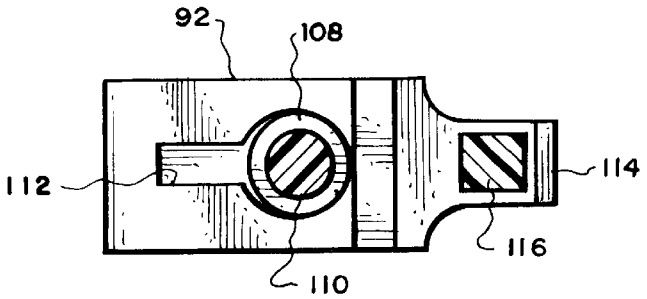
FIGS. 13 is partial sectional view taken at 13—13 of FIG. 12.
Figure 12:
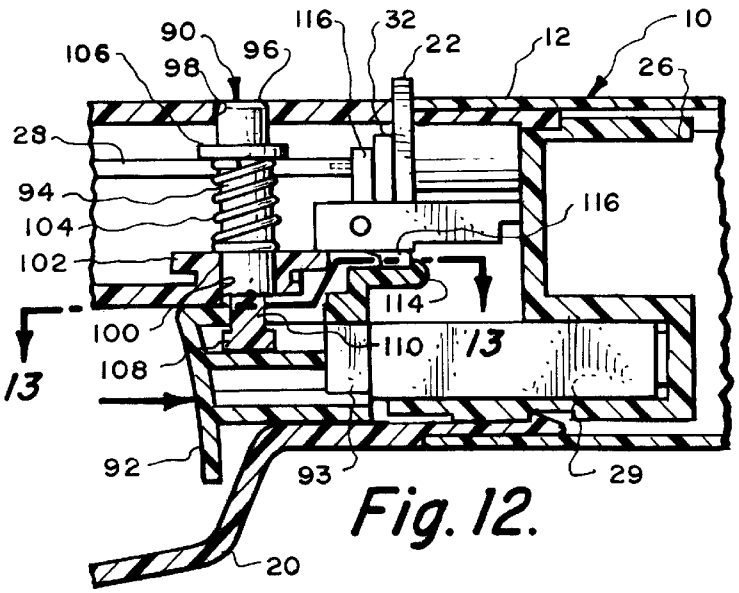
FIGS. 11 and 12 are partial sectional views illustrating operation of the third embodiment of FIG. 9.
Figure 10:
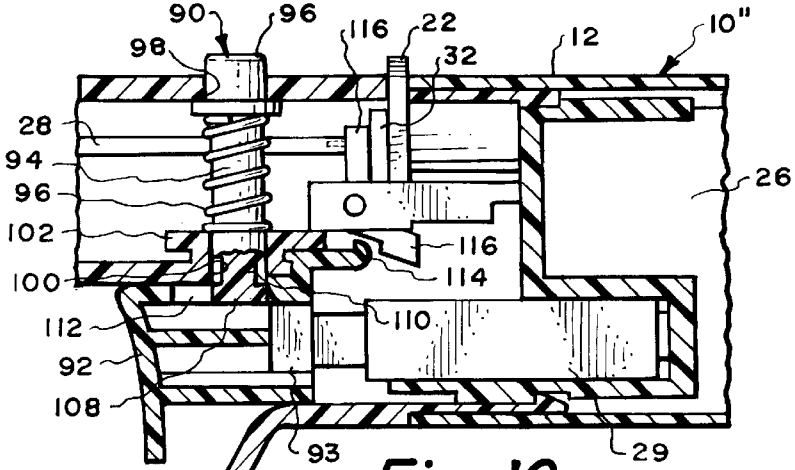
FIG. 10 is a partial sectional view of the third embodiment of the invention taken at 10—10 of FIG. 9.
Figure 11:
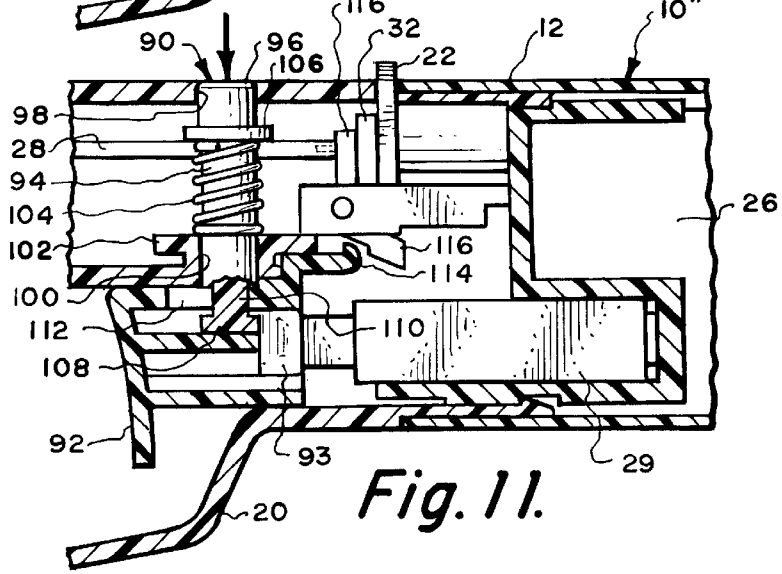

The operation of the trigger lock 90 is illustrated in FIGS. 11 through 13. To ignite a flame on BBQ lighter 10", extension 114, on trigger 92 engages lever 116 opening valve 32, as shown in FIGS. 11 and 12 , releasing fluid from reservoir 26 into delivery tube 28. Trigger lock 90 prevents operation of trigger 92 to ignite the flame until button 96 is activated. Stop disk 108 on stem 110 in keyhole slot 112, prevents a user from operating trigger 92.

To release trigger 92, button 96 on post 94 is pressed downward until stop disk 108 is disengaged from keyhole slot 112 in trigger 92. This allows the operator to pull the trigger fully back with stem 110 sliding into narrow portion 113 of keyhole slot 112 as illustrated in FIGS. 12 and 13.

With button 96 pressed, dislodging stop disk 108 from keyhole slot 112, trigger extension 114 engages lever 116, opening valve 132, releasing fluid 26 into tube 28. Simultaneously, trigger 92 activates plunger 93 on spark generator 29, creating a spark at the spark gap (not shown) which is identical with the embodiments shown in FIGS. 1 and 5. Button 96 is held down against the biasing force of coil spring 94 while trigger 92 is being operated.

Once the flame at the nozzle tip is lit it remains lit until trigger 92 is released. Releasing trigger 92 with button 96 released allows stop disk 108 to reengage slot 112 in trigger 92. With button 96 released and stop disk 108 engaging keyhole slot 112, the trigger is again prevented from being activated. Thus, when trigger 92 is released, it returns to the position shown in FIG. 10 and is again locked by stop disk 108 engaging keyhole slot 112, preventing operation.

Thus, there has been disclosed child resistant devices for BBQs or fireplace lighters. In one embodiment, a trigger release mechanism 34 comprised of a lever having an notch, engaging a plate on the trigger is provided. Trigger release mechanism 34 is mounted through a hole in the housing to the rear of, and immediately adjacent to the trigger guard 20 and trigger 18. The entire trigger mechanism is a single homogeneous construction comprised of a lever, an operating button and leaf spring, including a notch for locking the trigger to prevent use.

Trigger release mechanism 34 is simple and relatively easy to operate with one hand, by an adult, but requires sufficient dexterity to prevent use by children; particularly small children. The design and construction are such that it takes only slight movement to operate the device, yet it provides a secure lock of the trigger. A button, beneath the lighter housing 12, requires only a short movement against an integral leaf spring to release the trigger. It is not readily apparent that the movement of this button will release the trigger and would not only be difficult for a child to operate, but would be puzzling enough to deter or prevent them from using the lighter.

In a second embodiment a pivotable obstruction in the form of a plate that engages and obstructs the trigger. The trigger is formed with a recess for receiving the obstructing plate. A lever extending through an opening in the top of the lighter housing allows the trigger obstructing plate to be rotatably pivoted up and away for the trigger freeing it for operation. The obstructing plate rests in the recess against the trigger and obstructs operation and must be held up and away from the trigger during operation. The obstructing plate is spring biased or loaded to re-engage the recess in the trigger when the lever extending through the top of the housing is released. Manipulation is difficult if not impossible because the obstructing plate must be held away from the trigger continuously to keep the lighter ignited.

A third embodiment has a button exposed on the top of the lighter housing that prevents operation of the trigger and releases it when pressed. The button has a post with a stop disk on the end of a stem that engages a keyhole slot in the trigger preventing operation. Pressing and hold the button down disengages it from the keyhole slot allowing the trigger to freely move backward with the stem sliding in the narrow portion of the keyhole slot. The button is spring loaded to snap back into a blocking position when the trigger is released. When the trigger is released with the button released the spring cause the stop disk to reengage the keyhole slot as the trigger moves forward again preventing operation until the release button is pressed.

This invention is not to be limited by the embodiment shown in the drawings and described in the description which is given by way of example and not of limitation, but only in accordance with the scope of the appended claims.

What is claimed is:

1. An elongate lighter for igniting a flame to light BBQs, fireplaces and the like comprising;

a housing forming a handle;

a nozzle extending away from said handles having a nozzle tip;

a lighter fluid reservoir in said handle;

a tube for delivering said lighter fluid from said reservoir to said nozzle tip;

a spark at said nozzle tip;

spark generating means in said handle;

a trigger for releasing lighter fluid from said reservoir through said tube to said nozzle tip and sequentially activating said spark generator to ignite said lighter fluid producing a flame at said nozzle tip;

trigger locking guard means preventing operation of said trigger; said trigger locking guard comprising;

a guard plate positioned in front of said trigger;

said guard plate being mounted on a rotatable hub for displacement by rotation up and away from said hub;

and a thumb tab on said rotatable hub extending through an opening in said housing for rotating said guard plate up and away from said trigger so said trigger can be operated;

whereby displacing said guard plate away from said trigger allows operation of said trigger to light a flame at said nozzle tip.

2. The lighter according to claim 1 including biasing means biasing said guard plate back in front of said trigger when said thumb tab is released.

3. The lighter according to claim 2 in which said biasing means comprises a coil spring; said coil spring holding said guard plate against said trigger.

4. The lighter according to claim 3 including a trigger cover; said trigger cover having a notch for seating an end of said trigger guard plate.

5. Tne lighter according to claim 4 in which said trigger has a recess; said trigger guard plate being held in said recess by said biasing means.

6. The lighter according to claim 5 in which said trigger guard plate extends through an opening in a bottom portion of said housing; said thumb tab extends through an opening in said housing above said trigger; said trigger guard plate and thumb tab being formed on said rotatable hub.

* * * * *